US011325015B1

(12) United States Patent
Modawell

(10) Patent No.: US 11,325,015 B1
(45) Date of Patent: May 10, 2022

(54) GOLF TRAINING DEVICE

(71) Applicant: Kerry Modawell, Granbury, TX (US)

(72) Inventor: Kerry Modawell, Granbury, TX (US)

( * ) Notice: Subject to any disclaimer, the term of this patent is extended or adjusted under 35 U.S.C. 154(b) by 0 days.

(21) Appl. No.: 17/128,119

(22) Filed: Dec. 20, 2020

Related U.S. Application Data

(60) Provisional application No. 62/951,406, filed on Dec. 20, 2019.

(51) Int. Cl.
*A63B 69/36* (2006.01)

(52) U.S. Cl.
CPC .... *A63B 69/3673* (2013.01); *A63B 2069/367* (2013.01)

(58) Field of Classification Search
CPC ..... A63B 69/3673; A63B 2069/367
USPC ..... 473/269, 270, 273, 278
See application file for complete search history.

(56) References Cited

U.S. PATENT DOCUMENTS 2,879,996 A * 3/1959 Lederer ..... A63B 69/3652 473/279
3,352,559 A * 11/1967 Larsen ..... A63B 69/3667 473/269
3,639,923 A * 2/1972 Stewart ..... A63B 69/3652 473/269
4,088,325 A * 5/1978 Sutton ..... A63B 69/3667 472/110
4,146,231 A * 3/1979 Merkle ..... A63B 69/3667 473/269
5,076,580 A * 12/1991 Lang ..... A63B 69/0002 473/417
5,417,427 A * 5/1995 Doane ..... A63B 69/0091 473/145
6,450,895 B1 * 9/2002 Galluzzo, Jr. ..... A63B 69/3652 473/279
7,625,294 B1 * 12/2009 Isaac ..... A63B 69/3667 473/218
D648,403 S * 11/2011 Hanifee ..... D21/688

* cited by examiner

*Primary Examiner* — Nini F Legesse
(74) *Attorney, Agent, or Firm* — Kenneth L Tolar

(57) ABSTRACT

A golf training device comprising a base platform and a golf-ball platform that are interconnected with a telescoping, extendable rail. The base platform provides an area on which a golfer assumes a stance when addressing a golf ball. The rail is constructed with a rigid but pliable material that twists and contorts when a golfer is standing on the base platform. Therefore, the golfer must remain completely balanced while addressing the ball and swinging the club to prevent the platform from wobbling uncontrollably. The base platform is mounted on a turntable that allows a golfer to rotate the base platform between a first orientation where balance must be maintained in a direction parallel to the shoulders and a second orientation where balance must be maintained in a direction perpendicular to the shoulders.

8 Claims, 5 Drawing Sheets

GOLF TRAINING DEVICE

CROSS REFERENCE TO RELATED APPLICATIONS

This application claims priority of provisional application No. 62/951,406 filed on Dec. 20, 2019, the specification of which is incorporated herein by reference.

BACKGROUND OF THE INVENTION

The present invention relates to golf training device that enhances golfer balance and core strength to increase accuracy, power and distance.

DESCRIPTION OF THE PRIOR ART

Golf is an extremely popular sport in both the U.S. and abroad.

Becoming a proficient player mandates a proper and consistent swing. However, improving or perfecting a golf swing can be one of the most frustrating challenges for a golfer. Faulty swing mechanics leads to inconsistency, poor performance, and frustration. Golfers spend significant time and money on lessons and various training devices to improve ball-striking accuracy. However, most training techniques end in failure with the golfer showing little or no improvement.

The primary foundation to a consistent, accurate golf swing is a strong core and proper balance. A weak core generates slower swing speeds and limits power. In addition, because a weak core does not allow the golfer to maintain balance during a complete shoulder rotation, the golfer sways instead of maintaining the proper spine angle.

Maintaining proper balance at address and during the swing allows the golfer to control the club head and deliver the club face squarely to the ball, improving accuracy and distance. Balance also allows the golfer to generate higher clubhead speeds to produce maximum power. Conversely, like a weak core, lack of balance causes the golfer to sway during the backswing, which leaves the club face open or closed at impact.

Balance is improved primarily by core strengthening and balancing exercises. However, most conventional training techniques focus on grip, swing path and shoulder rotation while ignoring balance and core strength. Accordingly, there is currently a need for a golf training device that improves balance while strengthening core muscles to produce a more powerful and accurate golf swing. The present invention addresses this need by proving a training device including a base platform on which a golfer stands when addressing a ball that is positioned on a golf-ball platform. The base platform is supported by pliable rail that requires the golfer to remain balanced to prevent the platform from wobbling uncontrollably. By maintaining the proper balance on the unstable platform, the golfer also strengthens the pertinent core muscles that control balance.

SUMMARY OF THE INVENTION

The present invention relates to a golf training device comprising a base platform and a ball platform that are interconnected with a telescoping, extendable rail. The base platform provides an area on which a golfer stands when addressing a golf ball. The rail is constructed with a rigid but pliable material that twists and contorts when a golfer is standing on the base platform. Therefore, the golfer must remain completely balanced while addressing the ball and swinging the club to prevent the platform from wobbling uncontrollably. The base platform is mounted on a turntable that allows a golfer to rotate the base platform between a first orientation where balance must be maintained in a direction parallel to the shoulders and a second orientation where balance must be maintained in a direction perpendicular to the shoulders.

It is therefore an object of the present invention to provide a golf training device that increases balance and core strength.

It is therefore another object of the present invention to provide a golf training device that improves a golfer's stance.

It is yet another object of the present invention to provide a golf training device that improves a golfer's stance in all four horizontal directions.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1A:
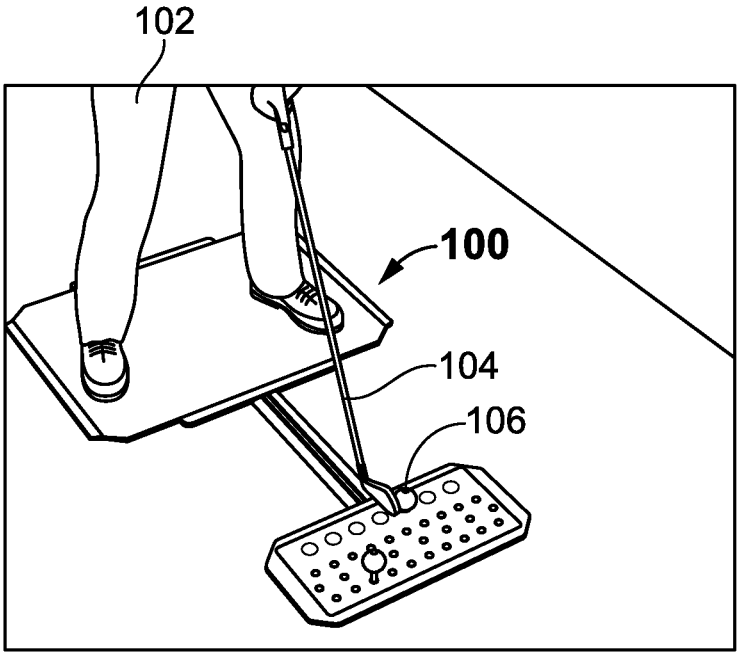
FIGS. 1A and 1B are front and rear perspective views of a golfer using the training device according to the present invention.

The present invention relates to a golf training device 100 comprising a base platform 108 and a golf-ball platform 110 that are interconnected by a telescoping, extendable rail 112. The base platform 108 provides an area on which a golfer stands when addressing a golf ball 106 with a golf club 104. Therefore, the upper surface of the base platform 108 includes multiple sets footprint outlines 124 to assist the golfer with properly positioning the feet when assuming a desired stance. The upper surface also preferably includes a roughened or textured layer that prevents a golfer's feet from sliding when swinging a golf club. Between or adjacent the sets of footprints are design elements 126, logos or similar indicia. The base platform is mounted on a turntable 10 formed of an upper plate 12 rotatably attached to a lower plate 13 with ball bearings (not pictured) positioned therebetween. The turntable is designed to withstand a load of at least 400 pounds to safely support golfers standing on the base platform.

Figure 1B:
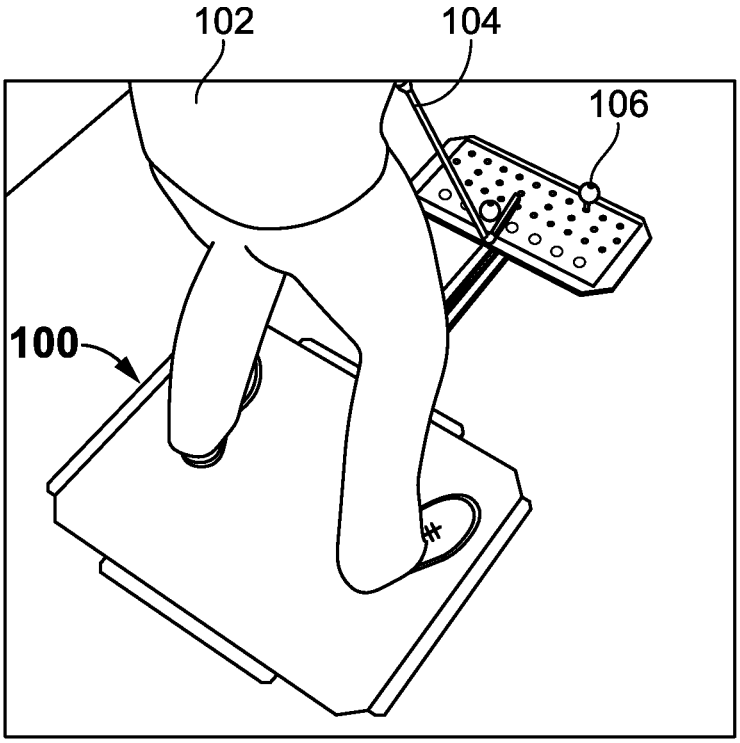
Figure 2:
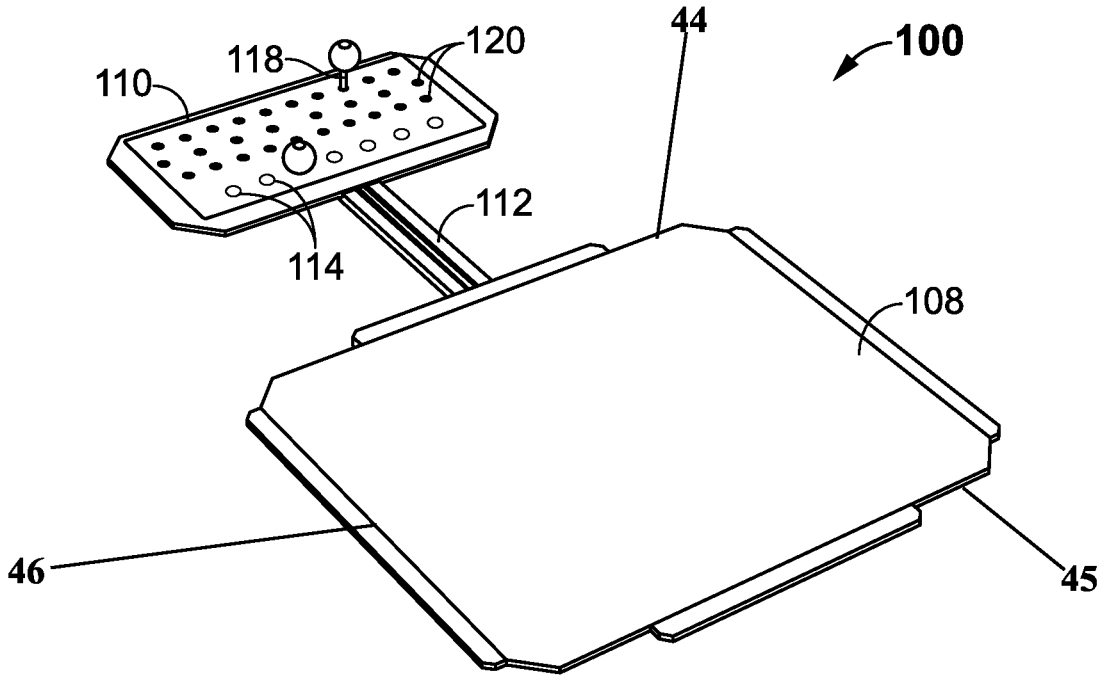
FIG. 2 is an isolated, perspective view of the golf training device.
Figure 3:
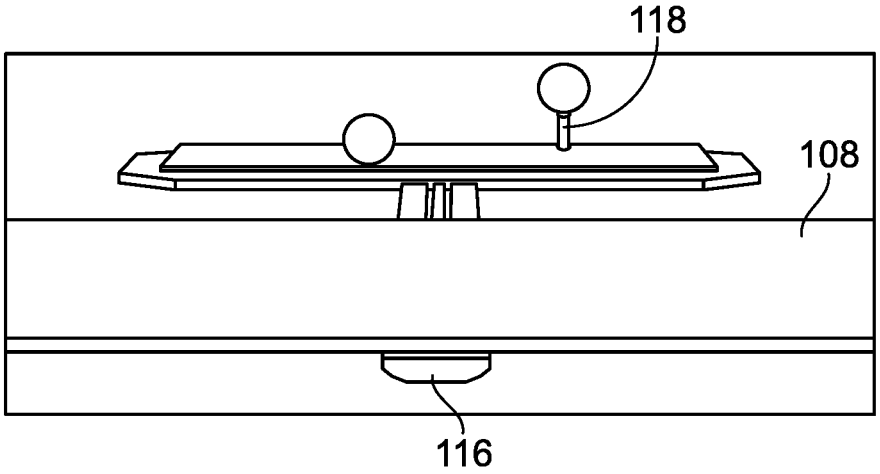
FIG. 3 is a rear end view of the golf training device.
Figure 4:
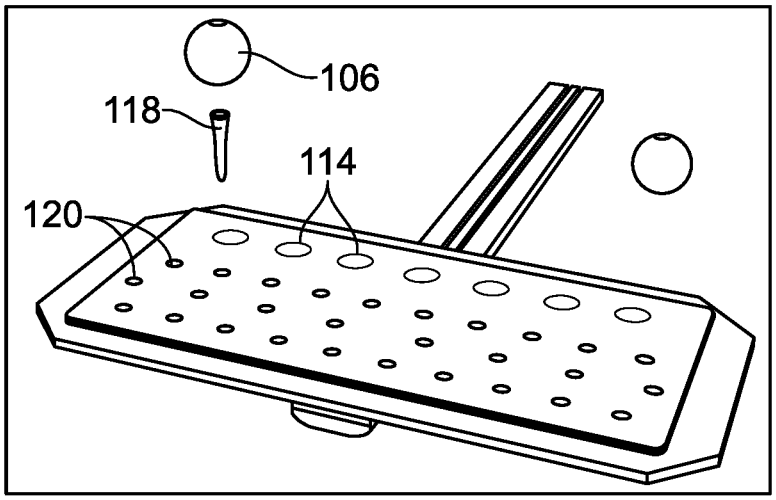
FIG. 4 is an isolated, perspective view of the golf-ball platform.
Figure 6:
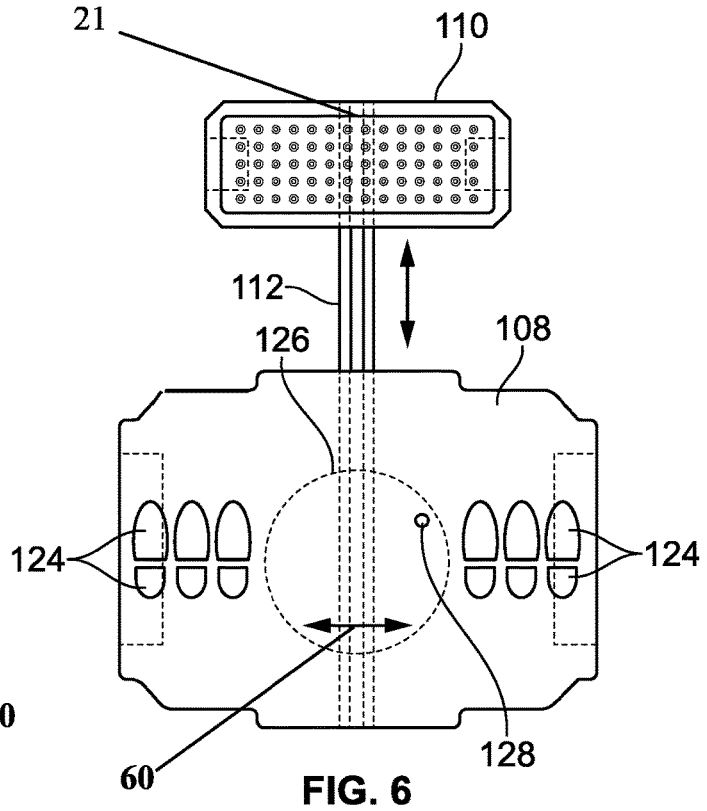
FIG. 6 is a top view of the golf training device.
Figure 7:
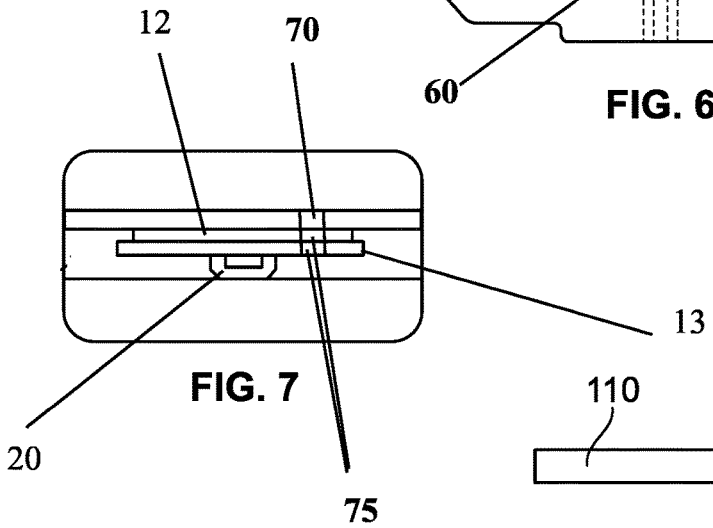
FIG. 7 is an end view of the base platform and attached rails.
Figure 8A:
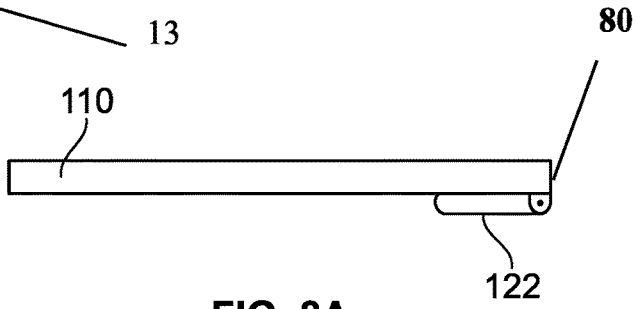
FIGS. 8A and 8B are side views of the golf-ball platform with the stabilizing supports in collapsed and deployed positions.
Figure 8B:
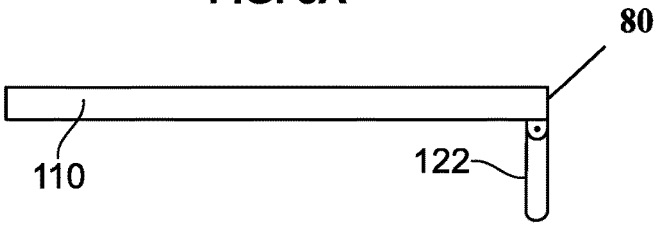
Figure 9:
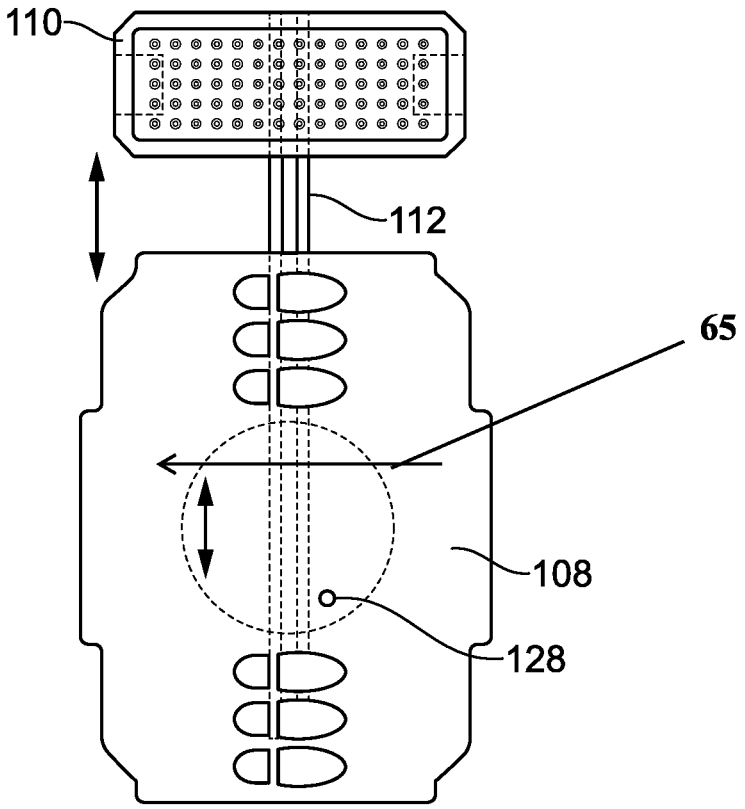
FIG. 9 is a top view of the base platform rotated 90 degrees to stress balance in a different direction.

The turntable allows a golfer 102 to rotate the base platform between a first orientation as depicted in FIGS. 1, 2 and 6 and a second orientation as depicted in FIG. 9. In the first orientation, the golfer must maintain balance in a vector 60 that is parallel to the shoulders. In the second orientation, the golfer must maintain balance in a second vector 65 that is perpendicular to the shoulders. Therefore, the golfer can improve balance in all four horizontal directions as is necessary to perfect a golf swing. The upper surface of the base platform further includes an aperture 70 that aligns with bores 75 on the upper and lower plates. By removing a locking pin 128, a user can rotate and fix the base platform in either of the two orientations, as desired.

The rail is formed of an outer U-shaped section 20 fastened to the lower turntable plate 13 and an inner section 21 affixed to the bottom surface of the golf ball platform 110. The inner section 21 slides within a channel formed on the outer section to selectively space the base and golf-ball platforms. A stop member or similar mechanism limits the extension of the rail to prevent compete detachment of the rail sections. Therefore, the distance between the golf-ball platform and the base platform can be selectively adjusted according to the size of the golfer and/or the golfer's preference.

Figure 5A:
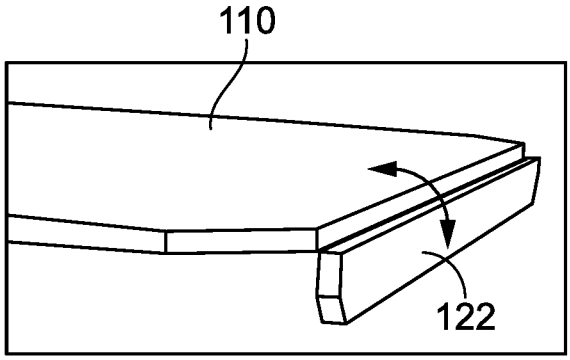
FIG. 5A is a perspective view of the golf-ball platform with foldable support/stabilizing stands.
Figure 5B:
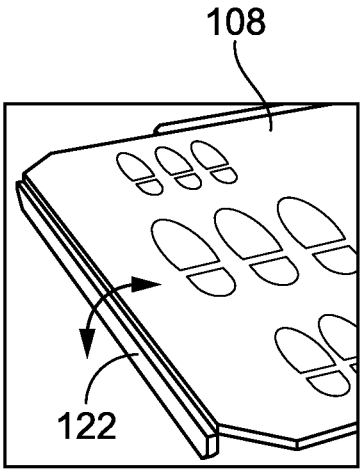
FIG. 5B is a perspective view of the base platform with foldable support/stabilizing stands.

The rail is constructed with a rigid but pliable material so that the portion 116 beneath the elevated base platform twists and contorts when a golfer is standing thereon. Therefore, the golfer must remain completely balanced while addressing the ball and swinging the club to prevent the platform from wobbling uncontrollably. The top 44, bottom 45 and side edges 46 of the base platform have hinged supports 122 that can be deployed to a vertical position as depicted in FIGS. 5A and 5B. Both supports can be deployed to anchor the base platform on an underlying surface if the golfer wants to foregoing balance training; or one of the supports can be deployed if the golfer wants to practice transferring body weight to the front foot on the follow-through without addressing balance in the finish.

Figure 10A:
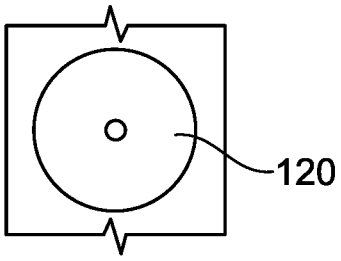
FIG. 10A is a top, plan view of a ball indention.
Figure 10B:
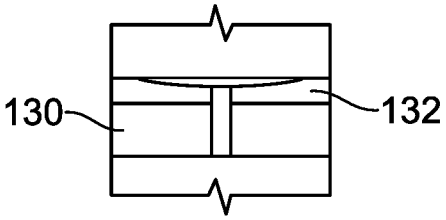
FIG. 10B is a side, sectional view of the golf-ball platform.

Referring now to FIGS. 10A and 10B, the golf-ball platform is formed of a tray 130 having a recess on an upper surface that receives an adhesively bonded rubber sheet 132. The sheet includes a plurality of concave indentions 114 that are configured to cradle a golf ball when the golfer wishes to practice a fairway shot. The indentions will securely retain a golf ball even if the ball platform is wobbling slightly. The platform also includes a plurality of holes 120 for receiving golf tees 118 to allow the golfer to practice tee shots. The indentions 114 may also include holes 120 to interchangeably support a tee or a golf ball. A pivotal support stand 122 deployable from each side edge 80 of the golf-ball platform stabilizes it while the base platform and rail are twisting.

The above-described device is not limited to the exact details of construction and enumeration of parts provided herein. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A golf training device comprising:

a base platform on which a golfer stands, said base platform having a top edge, a bottom edge, and two opposing side edges;

a golf-ball platform spaced from and connected to said base platform, said golf-ball platform having two opposing side edges;

a narrow telescoping, extendable rail interconnecting said base platform and said golf-ball platform, said narrow telescoping extendable rail positioned beneath said base platform and extending from the top edge to the bottom edge so that a portion beneath said base platform twists and contorts when a golfer is standing thereon so that the golfer must remain balanced while swinging a golf club to prevent the base platform from wobbling uncontrollably.

2. The golf training device according to claim 1 further comprising:

a hinged support at the top edge, the bottom edge and the two opposing side edge that are deployable to a vertical position to anchor the base platform on an underlying surface.

3. The golf training device according to claim 1 further comprising:

means for rotating said base platform between a first orientation wherein the golfer must maintain balance in a vector that is parallel to a golfer's shoulders and a second orientation wherein the golfer must maintain balance in a second vector that is perpendicular to the golfer's shoulders.

4. The golf training device according to claim 3 wherein said means for rotating said base platform comprises said base platform mounted on a turntable.

5. The golf training device according to claim 4 further comprising:

an aperture on an upper surface of the base platform, said aperture aligning with a bore on said turntable;

a locking pin received within said aperture and said bore to lock said base platform in either the first orientation or the second orientation.

6. The golf training device according to claim 1 wherein the golf-ball platform includes a plurality of concave indentions that are configured to cradle a golf ball when the golfer wishes to practice a fairway shot.

7. The golf training device according to claim 6 wherein the golf-ball platform further includes a plurality of holes for receiving golf tees to allow the golfer to practice tee shots.

8. The golf training device according to claim 1 wherein said golf-ball platform includes a pivotal support stand deployable from each of said two opposing side edges that stabilize said golf-ball platform when said rail is twisting.

* * * * *